US006536245B2

(12) United States Patent
Chiang

(10) Patent No.: US 6,536,245 B2
(45) Date of Patent: Mar. 25, 2003

(54) PANIC DOOR LOCK

(76) Inventor: Fanny Chiang, 11 Fl. -4, No. 16, Chungming S Rd., Taichung (TW)

( * ) Notice: Subject to any disclaimer, the term of this patent is extended or adjusted under 35 U.S.C. 154(b) by 0 days.

(21) Appl. No.: 09/957,862

(22) Filed: Sep. 21, 2001

(65) Prior Publication Data

US 2002/0038561 A1 Apr. 4, 2002

(30) Foreign Application Priority Data

Sep. 30, 2000 (TW) ..... 089217030

(51) Int. Cl.[7] ..... E05B 59/00; E05B 63/14; E05B 63/20

(52) U.S. Cl. ..... 70/107; 70/151 R; 70/486; 70/DIG. 6; 292/335

(58) Field of Search ..... 70/107, DIG. 6, 70/151 R, 151 A, 486; 292/169.14, 332, 335, 336

(56) References Cited

U.S. PATENT DOCUMENTS 1,107,736 A * 8/1914 Wilkinson et al.
1,302,873 A * 5/1919 Stiff
1,340,398 A * 5/1920 O'Brien
1,504,316 A * 8/1924 Beauchamp
1,559,423 A * 10/1925 Hartzler
4,840,050 A * 6/1989 Gotanda ..... 70/107
4,854,619 A * 8/1989 Nakauchi ..... 292/335
5,927,769 A * 7/1999 Pullen ..... 292/169.13

FOREIGN PATENT DOCUMENTS

FR 593058 * 8/1925 ..... 292/336
GB 2039983 * 8/1980 ..... 292/335

* cited by examiner

*Primary Examiner*—Lloyd A. Gall
(74) *Attorney, Agent, or Firm*—Kolisch Hartwell, P.C.

(57) ABSTRACT

A panic door lock includes a housing and a dead bolt that is movable in the housing between an extended position and a retracted position. The dead bolt is spring-loaded and tends to be moved to the extended position. The dead bolt has a slot defined in place therein. A detent has an inner claw adapted to enter the slot and retain the dead bolt in the retracted position as long as the dead bolt is moved to the first retracted position. In addition, a spring-loaded trigger having a tip normally extended out the housing is provided. The trigger is engagable with the detent so that the inner claw may exit the slot and release the dead bolt from the retracted position when the tip of the trigger is pressed into the housing.

8 Claims, 4 Drawing Sheets

PANIC DOOR LOCK

BACKGROUND OF THE INVENTION

1. Field of the Invention

The present invention relates to a panic door lock and, more particularly, to a panic door lock in which a dead bolt will extend out of itself as soon as the door is fully closed and can be opened either by turning a key or handle.

2. Description of Related Art

There are various types of door locks that each have a dead bolt and a latch bolt. These locks have no risk of being opened by a thief with a thin piece of picklock. However, the dead bolt can not retract back and then extend out of itself, as the latch bolt can, when the door is closed. In other words, a key must be used every time when the door is desired to be securely locked.

Therefore, it is an objective of the invention to provide a panic door lock to mitigate and/or obviate the aforementioned problem.

SUMMARY OF THE INVENTION

The object of the present invention is to provide a panic door lock in which a dead bolt will extend out of itself as soon as the door is fully closed and can be opened either by turning a key or handle.

Other objects, advantages and novel features of the invention will become more apparent from the following detailed description when taken in conjunction with the accompanying drawings.

DETAILED DESCRIPTION OF THE PREFERRED EMBODIMENT

Figure 1:
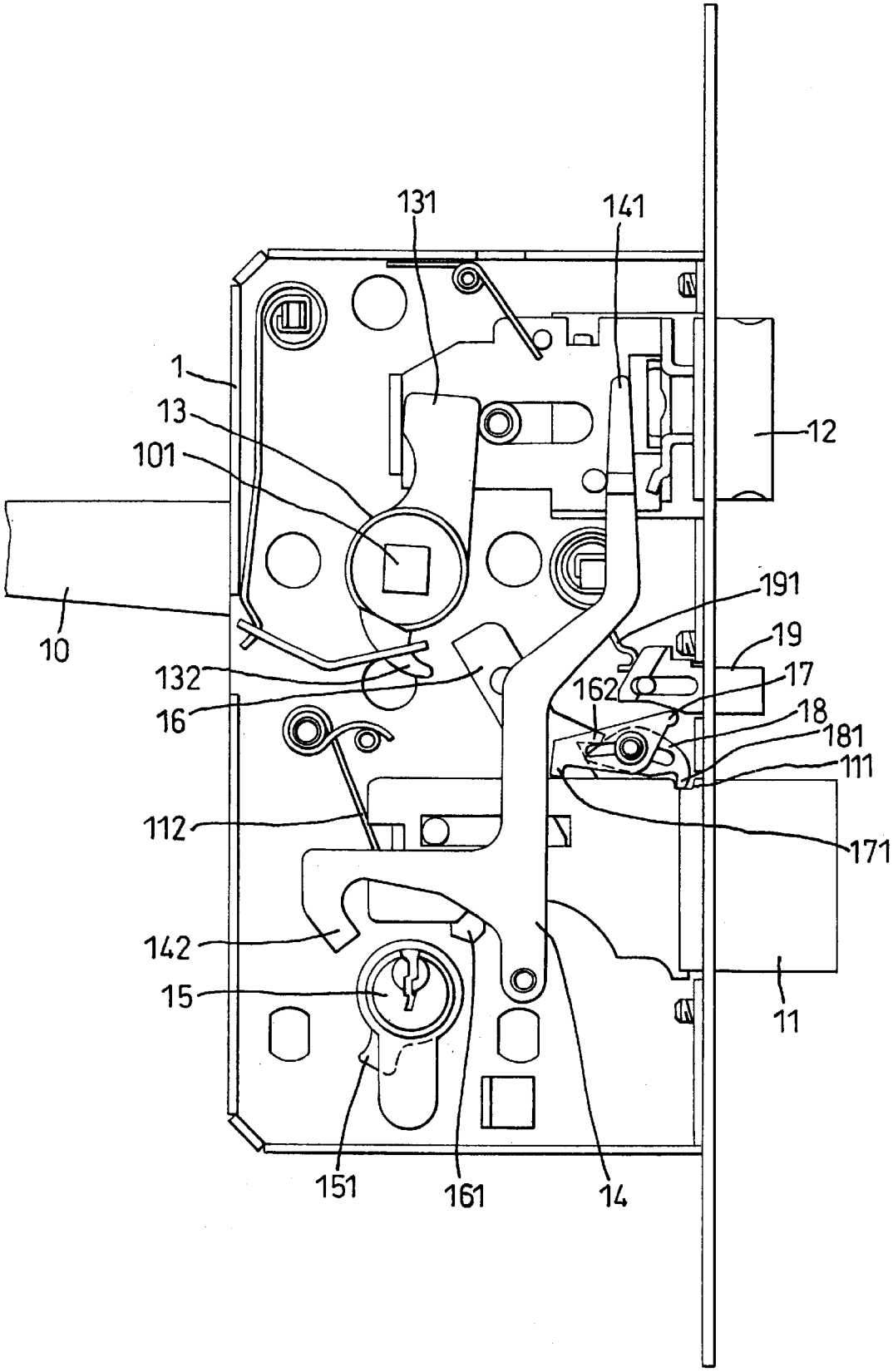
FIG. 1 is an internal view of a preferred embodiment of a panic door lock in accordance with the present invention, showing a dead bolt and a latch bolt in their extended positions.
Figure 2:
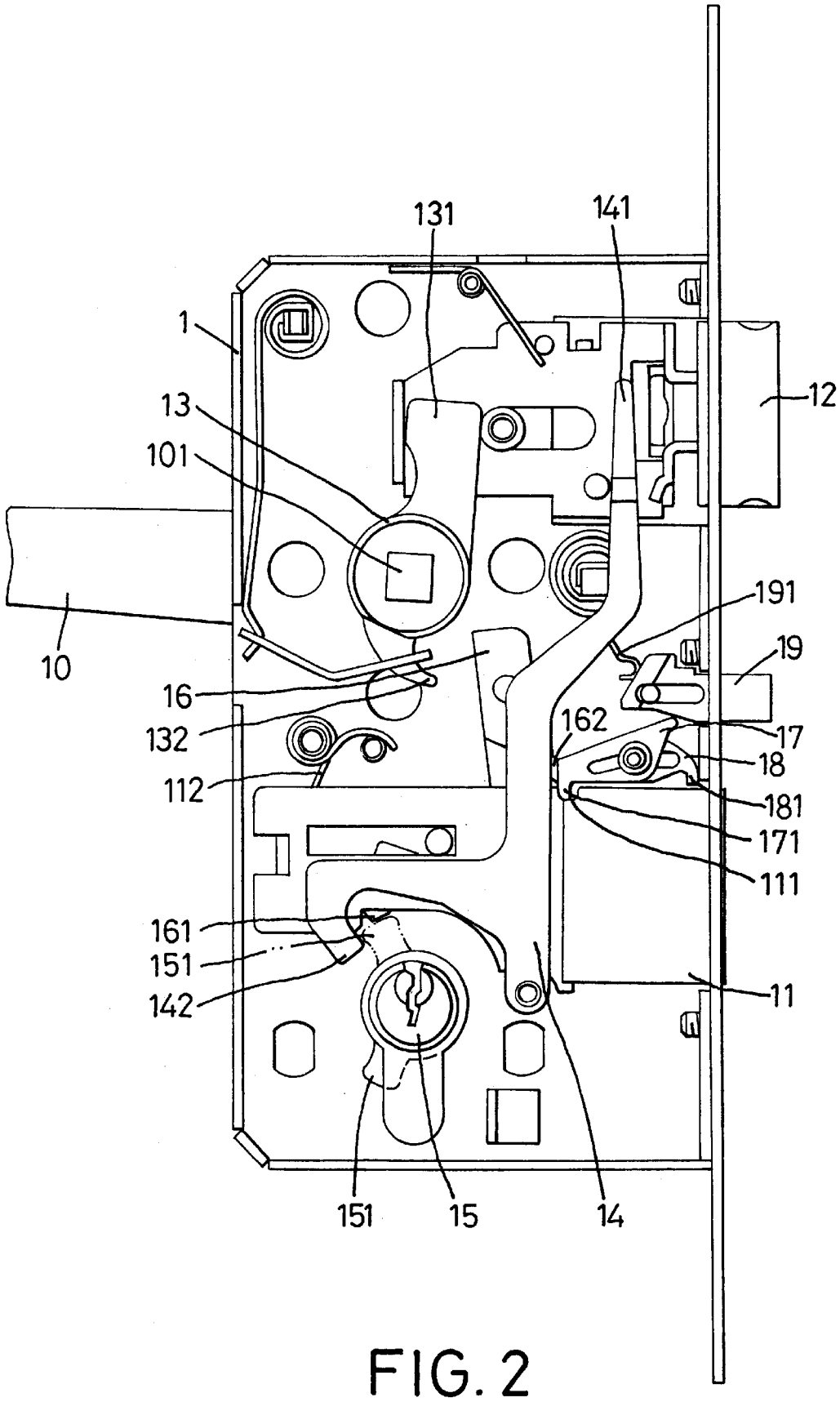
FIG. 2 is an internal view of the panic door lock of FIG. 1. showing the dead bolt moved to its retracted position by turning a key.

Referring to FIGS. 1 and 2, a panic door lock in accordance with the present invention includes a housing (1) that accommodates dead bolts (11) and a latch bolt (12), with each of the bolts (11,12) being movable in the housing (1) between an extended position and a retracted position. The dead bolt (11) is spring-loaded, such as by a torsion spring (112), in such a way that the bolt (11) tends to be moved to its extended position. In addition, the dead bolt (11) has a slot (111) defined in place therein.

Pivoted on the casing (1) above the dead bolt (11) are a detent (17) and a tumbler (18). The detent (17) has an) inner claw (171) adapted to enter the slot (111) as long as the dead bolt (11) is in its retracted position, as shown in FIG. 2.

The tumbler (18) has an outer claw (181) and may turn or to be turned to a holding position, in which the outer claw (181) enters the slot (111), when the dead bolt (11) is in its extended position, as shown in FIG. 1. The tumbler (18) may be turned away from its holding position, by means of a rocker (16) that has a first paw (161) and a second paw (162).

The rocker (16) is pivotal between two angular positions. When the rocker (16) is turned from its first angular position to its second angular position, i.e., in a clockwise direction as viewed from FIGS. 1 and 2, the first paw (161) will push the dead bolt (11) to the retracted position while the second paw (162) will turn the tumbler (18) away from the holding position by engaging a top edge of the tumbler (18), as can be clearly seen in FIG. 1.

A cylinder (15), which can be turned by a key (not shown) either indoors or outdoors, is disposed rotatably in the housing (1). The cylinder (15) is formed with a butt (151) that is rotatable with the cylinder (15) to turn the rocker (16) clockwise from the first angular position to the second angular position by way of pushing the first paw (161).

In addition to die rocker (16), a pivoted lever (14) having a stretched leg (141) and a hooked leg (142) can also be turned by the butt (151), in order to move the latch bolt (12) to its retracted position, by virtue of pushing a pin (not numbered) of the bolt (12) with the stretched leg (141).

The panic door lock can be opened by turning the key in the cylinder (15), either indoors or outdoors. The rotation of the cylinder (15) brings the butt (151) into contact with the first paw (161) of the rocker (16). As the butt (151) pushes the paw (161), the rocker (16) is turned clockwise from the first angular position towards the second angular position and so the second paw (162) of the rocker (16) drives the tumbler (181) away from the holding position by engaging and pressing the top edge of the tumbler, which forces the outer claw (181) to exit the slot (111) of the dead bolt (11) and releases the same bolt (11) from its extended position.

With the continuous pushing of the butt (151), the first paw (161) is brought into contact with the dead bolt (11) and moves the bolt (11) to the retracted position. It is at this time that the inner claw (171) of the detent (17) enters or falls into the slot (111), due to the gravitation upon the off-set detent (17), thereby retaining the dead bolt (11) in its retracted position, as best shown in FIG. 2.

The rotating butt (151) also pushes the hooked leg (142) of the pivoted lever (14) as well as the paw (161), and so turns the lever (14) in a counter-clockwise direction, as viewed from FIGS. 1 and 2. Consequently, the stretched leg (141) of the lever (11) pushes the pin and hence moves the latch bolt (12) from its extended position to its retracted position, as shown in FIG. 4.

It is to be appreciated that the inventive lock is opened at the moment when the bolts (11,12) are moved to their retracted positions.

Figure 3:
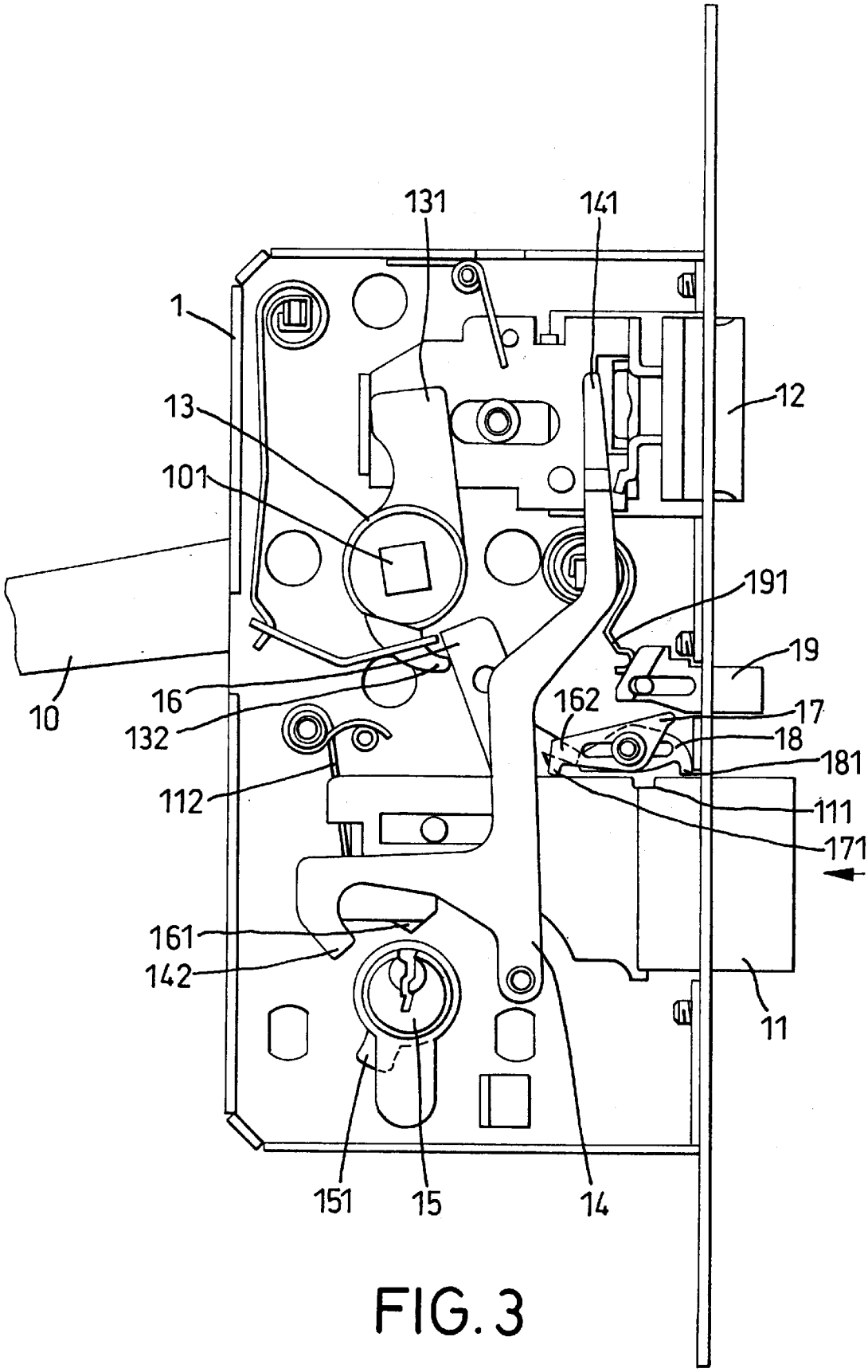
FIG. 3 is an internal view of the panic door lock of FIG. 1, showing the lock being opened or the bolts being moved towards their retracted positions by turning a handle; lid
Figure 4:
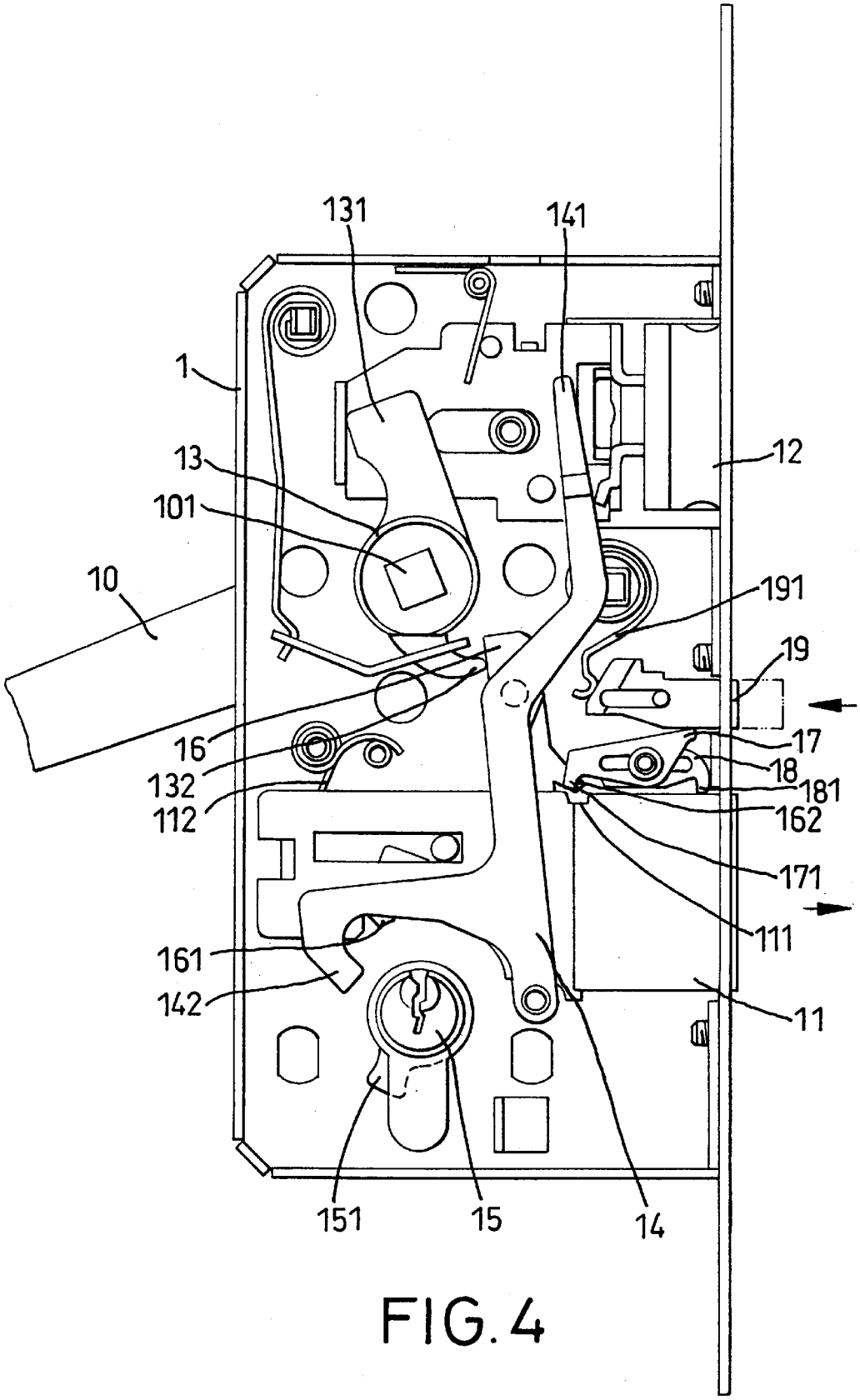
FIG. 4 is an internal view of the panic door lock of FIG. 1, showing the latch bolt and dead bolt being opened completely by turning a handle.

Referring to FIGS. 3 and 4, there is provided a handle (10) that can move the bolt (11, 12) to the retracted positions without the key.

The handle (10) includes a square axle (101) formed with a follower (13) which is rotatable with the handle (10). The follower (13), as well known to those skilled in the art, has a first arm (131) to push the latch bolt (12) to the retracted position. However, the follower (131) further has a second arm (132) that is used to turn the rocker (16) from the first angular position to the second angular position, instead of the butt (151) of the cylinder (15).

As a result, the inventive door lock can also be opened by turning the handle (10). Here the rotation of the follower

(13) with the handle (10) brings the first arm (131) into contact with the latch bolt (12). The first arm (131) then pushes the latch bolt (12) leftwards, as viewed in FIG. 3, thereby moving the bolt (12) from the extended position to the retracted position.

The rotation of the follower (13) with the handle (10) also brings the second arm (132) into contact with the rocker (16). The second arm (132) then pushes the rocker (16) and turns it clockwise from the first angular position towards the second angular position.

As mentioned above with reference to FIGS. 1 and 2, the second paw (162) is now pressed against the tumbler (18) at its top edge, and so the tumbler (18) is turned away from the holding position, forcing the outer law (181) to exit the slot (111) of the dead bolt (11) and releasing the same bolt (11) from its extended position.

The first paw (161) of the rocker (16) is then brought into contact with the dead bolt (11), moving the bolt (11) to the retracted position, in which the inner claw (171) of the detent (17) enters or falls into the slot (111), thereby retaining the dead bolt (11) in its retracted position.

Referring back to FIG. 2, it is important that a spring-loaded trigger (19) is provided at a side of the housing (1) between the two bolts (11,12). This trigger (19) is springloaded, such as by a coil spring (191), in such a way that a tip of the trigger (19) is normally extended out the housing (1). Additionally, the trigger (19) has a bottom edge engagable with the detent (17).

If the tip of the trigger (19) is pressed into the housing (1), especially by a doorframe or a door strike when the door provided with the inventive lock is being closed, the bottom edge of the trigger (19) is engaged with and pressed against the detent (17), turning the detent (17) away from its holding position. Thus the inner claw (171) of the detent (17) exits the slot (111) and releases the dead bolt (11) from its retracted position.

Having been released from its retracted position the, dead bolt (11) is moved rightward quickly, under the action of the torsion spring (112), turning the rocker (16) in a counter-clockwise direction back to the first angular position by way of pushing the first paw (161).

The dead lock (11) is moved until it reaches its extended position, when the outer claw (181) of the tumbler (18) enters the slot (111) again, thereby retaining the dead bolt (11) in its extended position, as shown in FIG. 1.

From the foregoing, it is clear that the dead bolt (11) will extend out the housing (1) of itself as soon as the door is fully closed.

It is to be understood, however, that even though numerous characteristic and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A panic door lock comprising:

a housing (1);

a dead bolt (11) movable in said housing (1) between a first extended position and a first retracted position, said dead bolt (11) being spring-loaded and tending to be moved to said first extended position, said dead bolt (11) having a slot (111) defined therein;

a detent (17) pivoted on said housing and having an inner claw (171) adapted to enter said slot (111) and retain said dead bolt (11) in said first retracted position as long as said dead bolt (11) is moved to said first retracted position;

a tumbler (18) pivoted on said housing (1) and having an outer claw (181), said tumbler (18) being adapted to be driven to a holding position, in which said outer claw (181) enters said slot (111) and retains said dead bolt (11) in said first extended position, as long as said dead bolt (11) is moved to said first extended position;

a rocker (16) for driving said tumbler (18) away from said holding position so that said outer claw (181) may exit said slot (111) and release said dead bolt from said extended position; and a spring-loaded trigger (19) having a tip normally extended out from said housing (1), said trigger (19) engageable with said detent (17) so that said inner claw (171) may exit said slot (111) and release said dead bolt (11) from said first retracted position when said tip of said trigger (19) is pressed into said housing (1).

2. The panic door lock as claimed in claim 1, wherein said rocker (16) is pivotal relative to said housing (1) between a first angular position and a second angular position, and wherein said rocker (16) has a first paw (161) and a second paw (162).

3. The panic door lock as claimed in claim 2, wherein said first paw (161) is adapted to push said dead bolt (11) from said first extended position to said first retracted position when said rocker (16) is turned from said first angular position to said second angular position, and wherein said second paw (162) is adapted to turn said tumbler (18) away from said holding position also when said rocker (16) is turned from said first angular position to said second angular position.

4. The panic door lock as claimed in claimed 3 further including a cylinder (15) disposed rotatably in said housing (1) and formed with a butt (151) to turn said rocker (16) from said first angular position to said second angular position by way of pushing said first paw (161).

5. The panic door lock as claimed in claim 4, wherein said dead bolt (11) is adapted to turn said rocker (16) back to said first angular position by way of pushing said first paw (161) when said dead bolt (11) is released from said first retracted position and moved to said first extended position.

6. The panic door lock as claimed in claim 5 further including a latch bolt (12) movable in said housing (1) between a second extended position and a second retracted position, and a pivoted lever (14) to be turned by said butt (151) of said cylinder (15) so as to push said latch bolt (12) to said second retracted position.

7. The panic door lock as claimed in claim 6 further including a handle (10) for moving said bolts (11,12) to said retracted positions.

8. The panic door lock as claimed in claim 7, wherein said handle (10) is formed with a follower (13) rotatable with said handle (10), and wherein said follower (13) has a first arm (131) to push aid latch bolt (12) to said second retracted position and a second arm (132) to turn said rocker (16) to said second angular position, thereby moving, said bolts (11,12) to said retracted positions.

* * * * *